United States Patent [19]

Crasnianski

[11] 4,156,375

[45] May 29, 1979

[54] APPARATUS FOR PICKING PIN TUMBLER CYLINDER LOCKS

[75] Inventor: Serge Crasnianski, Grenoble, France

[73] Assignee: KIS France, Grenoble, France

[21] Appl. No.: 835,149

[22] Filed: Sep. 20, 1977

[30] Foreign Application Priority Data

Oct. 1, 1976 [FR] France ..... 76 29617

[51] Int. Cl.[2] ..... B25D 11/00

[52] U.S. Cl. ..... 81/3 R; 173/119

[58] Field of Search ..... 81/3 R; 173/100, 119, 173/120, 121; 70/394

[56] References Cited

U.S. PATENT DOCUMENTS

| | | | |
|---|---|---|---|
| 2,309,677 | 2/1943 | Segal | 81/3 R |
| 2,565,254 | 8/1951 | Miskill | 81/3 R |
| 3,264,908 | 8/1966 | Moore | 81/3 R |
| 3,448,817 | 6/1969 | Morishita et al. | 173/119 |
| 4,030,556 | 6/1977 | Phillips | 173/120 |

*Primary Examiner*—James L. Jones, Jr.
*Assistant Examiner*—James G. Smith
*Attorney, Agent, or Firm*—Frishauf, Holtz, Goodman & Woodward

[57] ABSTRACT

A motor driven rotary cam forces back a hammer against a spring and then suddenly releases it to provide an impact stroke to a pivoted massive lever which carries, at the end opposite the portion driven by a hammer, a lock pick needle held in a chuck. It is not necessary to feel out the position of the tumblers of the lock, because the impacts, repeated as necessary, drive the counter-pins away from the tumblers against their respective springs and an auxiliary tool carrying a weight, which does not need to be held in the hand of the operator, can turn the lock when the counter-pins have been propelled sufficiently far into the standing part of the lock. The force of the stroke, stroke length and repetition rate are all adjustable, as well as the torque applied by the auxiliary tool, in each case by a simple adjustment.

10 Claims, 3 Drawing Figures

APPARATUS FOR PICKING PIN TUMBLER CYLINDER LOCKS

This invention concerns a method of picking a cylinder lock of the pin tumbler type and a lock pick apparatus embodying the method, such as are useful for opening a lock of that type when the key has been lost and cannot be replaced.

In such cylinder locks the closure is secured in the locked condition by a plurality of spring-loaded counter-pins in the stator of the lock extending into the bores into which they respectively press the pin tumblers of the cylindrical rotor of the lock. The pin tumblers and counter-pins are so made that the projections and recesses on the key bit shift the tumblers, and with them the counter-pins, when the key is inserted, to the correct extent against the respective springs, so that the separation surface between pin tumbler and counter-pin brought exactly in alignment with the boundary between rotor and stator (cylinder and casing respectively). The cylinder can then be rotated so as to open the lock.

If the key to such a lock is lost or misplaced, it is possible only with the greatest difficulty to obtain by any other means the simultaneous precise shift of the individual pin tumblers and counter-pins, against the force of the springs, that will enable the lock to be opened.

It is known how to pick such a lock by means of a pistol-grip device carrying a pick needle in an operative position suitable for feeling out the tumblers and equipped with a trigger-operated mechanism for setting the needle into vibrations, in order to apply the vibrations to the tumblers and to the counter-pins and thereby to press the latter back into the stator. During that operation a rotary force is applied to the cylinder by means of a bent tool, so that the cylinder will turn as soon as the counter-pins have been forced back into the casing by acting on the tumblers. The ends of the auxiliary tool for exerting a rotary force on the cylinder are made in various ways and a set of such tools can be provided for opening locks of a variety of individual types. The operator, normally an experienced locksmith, inserts one end, namely a bent-over portion of the tool, into the keyway of the lock and presses on the other end to apply a rotary force to the cylinder. While rotary force is applied in this way, the locksmith inserts the needle of the pistol-grip tool into the keyway and seeks to determine the position of the tumblers and the exact place and position in which the needle can best be effective in order to align the tumblers in accordance with the unlocking combination. After he has performed this exploring function by feeling out the lock, he presses on the trigger, in order to vibrate the needle with a sudden movement.

It has been found in practice that opening a lock with such a gun tool and an auxiliary tool requires an inordinately large amount of time. It generally takes a half hour before an experienced locksmith can open a cylinder lock with these tools. The reason for the difficulty is that both of the hands of the locksmith are needed for this method of operation, one hand for holding the auxiliary tool and the other one for the opening instrument. Furthermore, the hand of the locksmith with which he holds the opening instrument must also at the same time actuate the trigger for the vibratory drive. These different manipulations, on the one hand the necessary fingertip feeling to explore the tumblers and, on the other hand, the force for pulling the trigger to release the vibratory movement, produce difficulties. Finally, the force that it is necessary to expend in order to apply force to the mechanism through the trigger until the release point of the mechanism is reached often results in loss of the exact position of the needle that has been laboriously established beforehand.

U.S. Pat. No. 3,264,908 disclosed a device, likewise in gun form, having a pack needle for insertion in the keyway of the lock for movement of the tumblers and counterpins, in which a weight is mounted so that it may swing about an axis, equipped to be excited into vibration by means of an electromagnet and a spring. The electromagnet is in this case connected to an alternating current supply, so that the weight and the needle execute sinusoidal vibrations.

With the device just described, the lock picking operation is indeed simplified, because the operator no longer needs to apply force to generate the vibratory movement of the pick needle and can therefore insert and place the gun-like tool more accurately, but a rapid alignment of the tumblers in the cylinder of the lock is still not possible, even with this device.

The Present Invention

It is an object of the present invention to provide a method and apparatus for picking pin tumbler cylinder locks in which the above-described disadvantages are overcome and which will make possible the opening of the lock by a sudden movement. It is an object of the invention to enable such opening of locks in less than a minute, relieving the operator of the device entirely from all operations requiring the application of force, for example for pressing a trigger, so that the operator can direct all his skill to finding a favorable position for the pick needle in the lock. It is also an object of the invention to provide an auxiliary tool that will enable him to hold the pick device with both hands.

Briefly, the lock pick tool has a pick needle arranged to be struck one or more times towards the counter-pins with so much energy that tumbler and counter-pin will separate as the counter-pin is thrown back into the locked casing (stator). In the method according to the invention, contrary to operations according to the disclosure of the above-mentioned U.S. patent, a shock or power pulse is applied to each individual tumbler, which shock or pulse is of such magnitude in energy that on the basis of the laws of conservation of momentum and of energy, the counter-pin abutting the end of the tumbler opposite to the end that receives the impact of the stroke separates from the tumbler and is driven back into the casing (stator) against its loading spring.

The method according to the invention can be performed particularly well with a lock pick device according to the invention in which a pick needle is fastened to a massive member in a hand-grip tool, for pressing back and adjusting the pin tumblers and counterpins, but in which, in contrast to the device described in the above-mentioned patent, a hammer is provided for applying an impact stroke on the tumblers through the pick needle, the hammer being thrown against the massive element carrying the pick needle in each stroke by an energy storage device charged by an electric motor drive. In order to perform the movements for generating a stroke and applying its impact on the pick needle, a preferred form of the invention utilizes a drive using a rotary cam with an effectively linear lifting or retracting characteristic and a sudden return stroke for first retracting the hammer from the massive member against a spring operating as an energy storage device and then releasing the spring to drive the hammer suddenly. The cam drive is in this case driven by an electric motor through a reduction gear in such a way that the hammer delivers individual impacts to the massive member at a sufficient spacing in time to allow transient oscillations following the stroke to die down between strokes. Quick opening of a cylinder lock is made possible in this way, because even after a few strokes, the individual counter-pins are so driven back that rotation of the cylinder in the lock casing is possible.

Since an electric motor drive is provided, the operator does not need to apply any substantial force in order to manipulate the device or to produce the oscillations of the pick needle.

By a further development of the invention, means are provided for adjusting the energy of each impact, the stroke length and the repetition rate of the impacts. The energy of the impact can be adjusted by variation of the bias of the spring, against which the hammer is moved by the cam drive. The stroke length can be determined by limiting the movement range of the weight (massive member) by means of a simple adjustable pin and the repetition rate of the strokes can be determined by adjustment of the rate of rotation of the electric motor drive, which is most simply done by means of a rheostat in the current supply circuit of the drive. Since in this mode of operation it is not necessary to feel out the position of the individual tumblers, it is also not necessary to provide the pick needle in a bent shape. It is sufficient, rather, to provide it in a simple cylindrical or parallel-piped rod shape, which is very easy to handle and manipulate.

The invention is further described by way of illustrative example with reference to the annexed drawings, in which.

Figure 1:
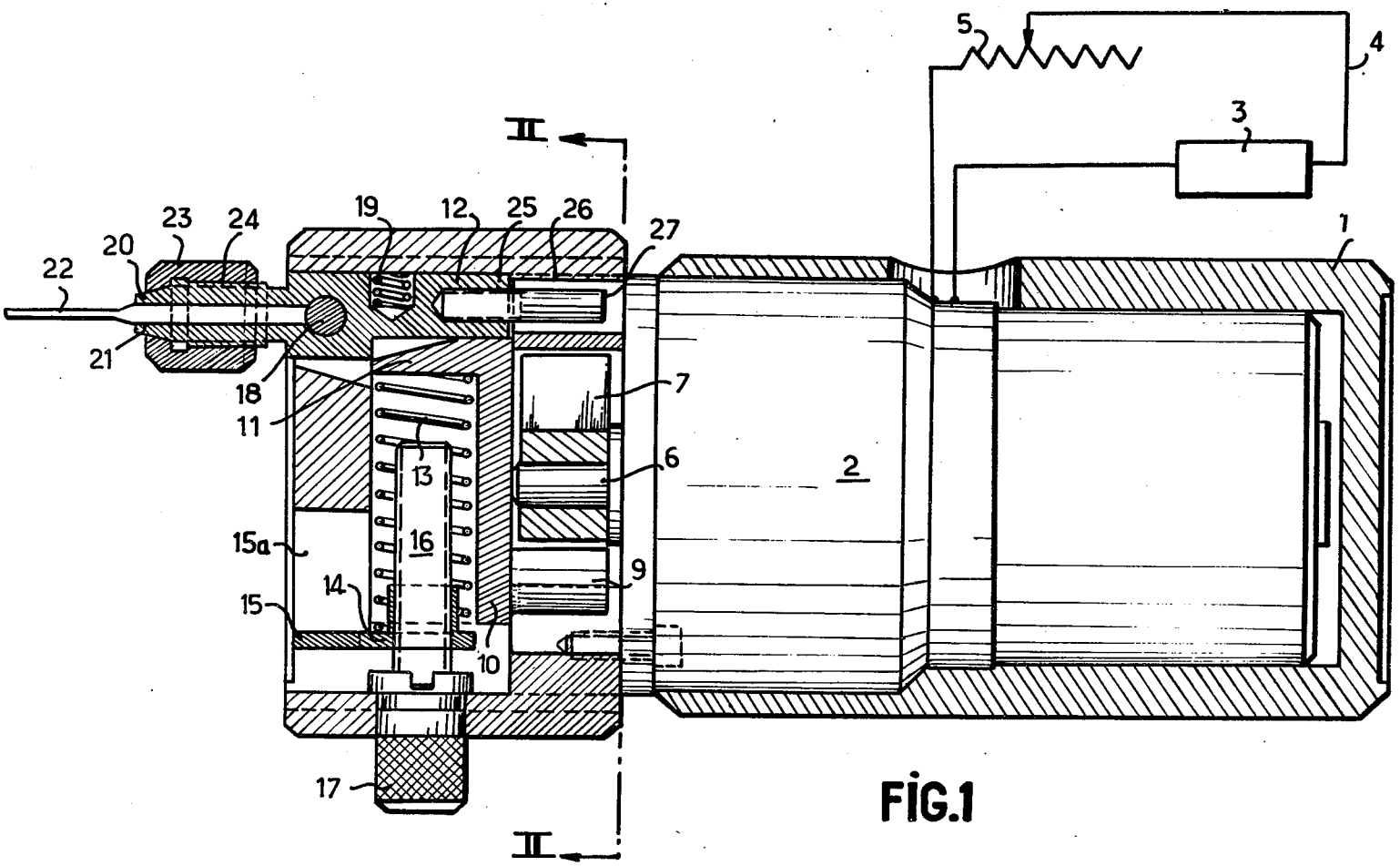
FIG. 1 is a longitudinal section passing through the central axis of the casing of a lock pick according to the invention.

As shown in FIG. 1, an electric motor drive including reduction gearing, collectively designated 2, is housed in a casing 1 consisting of two pieces held together with flanges. The drive is powered by a battery 3 to which it is connected by means of wire 4 and an interposed rheostat 5, the battery and rheostat having their own common housing.

Figure 2:
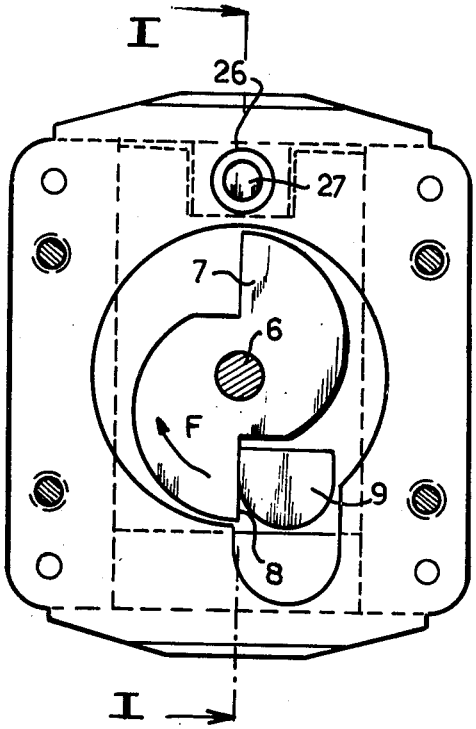
FIG. 2 is a section to the line II—II of FIG. 1.

At the free end of the shaft 6 of the reduction gear drive 2 a cam 7 is keyed to the shaft. The cam has two linear lifting curves (FIG. 2) (i.e. linear relation between radius and angle), each leading to a sudden step 8). The cam operates on a cam follower 9 that is part of a hammer 10, the end 11 of which strikes against a massive member 12 that operates as a weight set in motion by the stroke of the hammer. A restoring spring 13 bears at one end against the inner surface of the end 11 of the hammer 10 and at the other end against a nut 14 that has a guiding extension 15 that slides in a guideway 15*a* that is a cavity in the casing of the device. The nut 14 can be shifted axially by turning of a screw 16 by means of the knurled knob 17 in order to change the bias of the spring 13.

The massive member 12 can pivot on an axle rod 18 mounted in the casing. The swinging stroke of the member 12 is executed against the force of a spring 19 that presses the member 12 against the hammer 10, so that the massive lever 12 moves clockwise about the axle 18 by a certain amount when the hammer 10 is moved downwards.

The free end 20 of the massive lever 12 operates externally. It has a chuck 21 in which a pick needle 22 is held by means of a clamping nut 23 that is screwed onto the external threads 24 of the chuck. At the end 25 of the massive lever 12 on the opposite side of the axle 18 from the end 20 there is provided a cavity 26 in which the pin 27 set in the end of the lever 12 can move freely. By axial adjustment of the position of the pin 27 the stroke length of the pivoting movement of the lever 12 can be adjusted.

Figure 3:
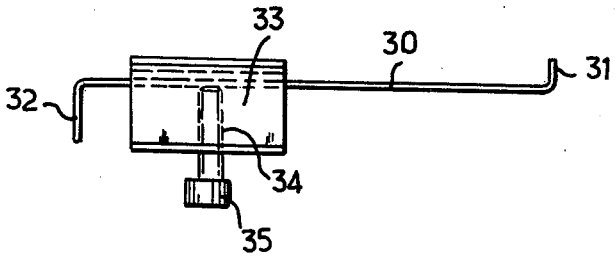
FIG. 3 is a top view of an auxiliary tool carrying out the method of the invention.

FIG. 3 shows an auxiliary tool consisting of a strip 30, preferably made of metal, the ends of which are bent over in opposite directions. On the strip itself a counterweight 33 can be shifted along its mid-portion. This counterweight 33 has a threaded bore 34 for seating a set screw 35 for the purpose of fixing the position of the counterweight 33 on the strip 30.

To operate with the lock pick according to the invention, the user holds the lock pick by the casing 1. The motor 2 turns the cam that at regular intervals releases the driving pin 9 of the hammer 10 in such a way that the end 11 of the hammer 10 suddenly strikes the massive lever 12 as the hammer 10 is driven by the spring 16 that serves as the energy storage device of the system. The massive lever thus provides the stroke by a counter-clockwise rotary movement about the axis 18 to the pick needle 22, the amplitude of the stroke being limited by the abutment of the pin 27 against the wall of the casing cavity 26.

By more or less rotation of the holding screw knob 17 and corresponding axial shift of the nut 14, the operator can change the degree of bias of the spring 16 and thereby the force with which the hammer 10 strikes the massive lever 12.

By variation of the resistance in the current supply circuit 4 of the electric motor by means of the rheostat 5, the rotation speed of the drive motor 2 and hence that of the cam 7 can be changed. In that way the repetition rate of the strokes of the hammer 10 on the massive lever 12 and hence the impact frequency of the needle 22 can be varied.

When the bent-over end 31 of the strip 30 is inserted in a lock, the counter-weight 33 on the strip 30 causes a torque to be exerted on the cylinder on the lock without requiring the operator to hold the auxiliary tool in his hand. By shifting the counterweight along the strip 30, the torque applied can be adjusted, so that between the adjustment of the motor-driven pick and the adjustment of the torque of the auxiliary tool, it is possible to utilize the equipment and method of the present invention successfully on a side variety of cylinder locks.

Although the invention has been described with reference to a particular illustrative embodiment, it will be understood that variations are possible within the inventive concept.

I claim:

1. A dynamic lock pick, for picking a cylinder lock having a plurality of pin tumblers in the cylinder resting in the locked condition repsectively against spring-loaded counter-pins housed in a stator, an end of each of the pin tumblers being accessible in a keyway, said pick comprising:

positioning; casing of a size and shape suitable for manual ositioning;

a pick needle (22) insertable in the keyway of a cylinder lock and mounted on a massive member located mainly within said casing and movable over a limited range of positions relative to said casing in a direction corresponding to movement of said pick needle transversely in said keyway;

means (27) for adjusting the range of movement of said massive member (12) in said casing and thereby adjusting the stroke length of said pick needle;

a hammer (11) movable mounted in said casing for hitting said massive member (12) carrying said pick needle so as to transmit shock to said pin tumblers when said pick needle is in a keyway of a cylinder lock;

a mechanical energy storage member (13) in said casing and bearing against said hammer;

an electric motor drive (2) for alternately storing energy in said energy storage member (13) by moving said hammer against said energy storage member and releasing said hammer and energy storage member suddenly to cause said hammer (11) to be thrown against said massive element (12) carrying said pick needle (22); and a restoring spring (19) for urging said massive member (12) in a direction towards said hammer for returning said massive element to the position of the beginning of a stroke.

2. A lock pick as defined in claim 1, in which said energy storage member is a spring (13) in said casing and in which said electric motor drive (2) includes a rotary cam (7) for alternately moving said hammer (11) against the force of said spring (13) and releasing said hammer and said spring.

3. A lock pick as defined in claim 2, comprising also means (14,16,17) for adjusting the bias force of said spring (13) exerted against said hammer (11).

4. A lock pick as defined in claim 3, in which said adjusting means (14,16) includes a screw having a knurled head accessible from the outside of said casing.

5. A lock pick as defined in claim 2, in which said movement range adjusting means includes an adjustable pin (27) movable in a cavity (26) of said casing, said adjustable pin (27) being so mounted adjustably on said massive member (12) that at the extremes of the stroke length set by its adjustment, its end lies against an edge of said opening (26).

6. A lock pick as defined in claim 1, comprising also means for adjusting the repetition rate of hammer strokes produced by said electric motor drive (2) by adjusting the supply of power to the electric motor of said electric motor drive.

7. A lock pick as defined in claim 6, in which said repetition rate adjusting means is a stepless adjusting means.

8. A lock pick as defined in claim 7, in which said stepless adjusting means is a rheostat (5).

9. An auxiliary tool for a trip hammered vibrating lock pick comprising a metal strip (30) bent over at right angles at both ends (31,32) in respectively opposite directions and an adjustable weight (3) slidably mounted on the mid-portion of said strip between its bent ends and having means (34,35) for fixing it at a selected position on said strip.

10. An auxiliary tool for a lock pick as defined in claim 9, in which said fixing means for said adjustable weight include a said screw (35) for releasably fixing said weight longitudinally of said mid-portion of said strip.

* * * * *